US006603859B1

(12) United States Patent
Asano

(10) Patent No.: US 6,603,859 B1
(45) Date of Patent: Aug. 5, 2003

(54) SPEAKER WITH DRIVE MECHANISM

(75) Inventor: Michihiro Asano, Tokyo (JP)

(73) Assignee: Nakamichi Corp., Tokyo (JP)

( * ) Notice: Subject to any disclaimer, the term of this patent is extended or adjusted under 35 U.S.C. 154(b) by 373 days.

(21) Appl. No.: 09/606,854

(22) Filed: Jun. 29, 2000

(30) Foreign Application Priority Data

Jun. 29, 1999 (JP) ..... 11-182671

(51) Int. Cl.[7] ..... H04R 29/00
(52) U.S. Cl. ..... 381/59; 381/300
(58) Field of Search ..... 381/300, 303, 381/304, 305, 96, 58, 59, 103, 387

(56) References Cited

U.S. PATENT DOCUMENTS 4,450,322 A * 5/1984 Wilson ..... 381/59
5,386,478 A * 1/1995 Plunkett ..... 381/103
5,430,802 A * 7/1995 Page ..... 381/96
6,384,550 B1 * 5/2002 Miyakawa ..... 381/96

* cited by examiner

*Primary Examiner*—Minsun Oh Harvey
(74) *Attorney, Agent, or Firm*—Darby & Darby

(57) ABSTRACT

A speaker with drive mechanism includes a plurality of speakers which can be moved individually or moved simultaneously without variations in positioning. The speaker with drive mechanism includes a memory, a memory for storing a current position of the speaker. When remote control signals indicating a speaker moving instruction are received, the received remote control signals are counted and the current position stored in the memory is updated. The result moves the commanded speaker to an updated address. Remote control signals indicating a relative speaker moving instruction may also be used to update the address in the memory.

9 Claims, 9 Drawing Sheets

PRIOR ART

PRIOR ART

SPEAKER WITH DRIVE MECHANISM

BACKGROUND OF THE INVENTION

The present invention relates to a speaker with drive mechanism. More particularly, the present invention relates to a speaker with a drive mechanism that can move a speaker along a support.

Surround sound has been used in recent years to provide a greater degree of realism, particularly in the viewing of movies. A surround sound system uses a plurality of speakers to provide a surrounding effect by having each speaker output sound appropriate to its sound field.

Referring to FIG. 8, a surround sound system 101, according to the prior art, contains six speakers and a main control unit MU to receive signals from a remote control 1. Surround sound system 101 provides surrounding effect wherein each speaker outputs sounds appropriate to its sound field. Speakers are arranged centered around a user P, allowing user P to perceive surrounding sound affects. i.e. A car moving.

As shown, surround sound system 101 includes, speaker FL to the front left of user P, speaker FR to the front right of user P, center speaker to the front of user P, speaker RL to the rear left of user P, speaker RR to the rear right of user P, center speaker C to the front of user P, and woofer speaker W. Speakers FL, FR, RL, RR and center speaker C surround the user P. Control cords C connect the main unit to each speakers to transmit control signals (remote control signals).

Speakers FL, FR, RL, and RR are constructed with drive mechanisms that move the speaker sections vertically. Speakers FL, FR, RL, and RR each contain microprocessors that control a drive mechanism through remote control signals received via control cord C. User P may indicate height for speakers FL, FR, RL, and RR from the listening point.

Referring to FIG. 9, the flowchart shows operations performed by the microprocessors in the speakers FL, FR, RL, RR. If a remote control signal is detected (step S11), the received remote control signal is checked to determine if an instruction to move the speaker up is received or if an instruction to move the speaker down is received (step S12). When the instruction is to move up, a drive mechanism moves the speaker up (step S13). Upward movement of a speaker continues during reception of the remote control signal (steps S12, S13, S15). When the instruction is to move down, a drive mechanism moves the speaker down (step S14). Downward movement of a speaker continues during reception of the remote control signal (steps S12, S14, S15). When the remote control signal ends, the speaker movement is stopped (step S 16).

To maximize the surrounding effect on user P, it is desirable to have speakers FL, FR, RL, and RR placed at optimal positions oriented to user P. However, positioning each of the surround sound system 101 speakers optimally is difficult due to variable room structure and variable height users.

Specific address solutions, having each position as a separate bit, require use of a specialized remote with multiple bits for the transmission code, and prevent the use of a cheaper general-purpose remote 1 with standard bits. Additionally, each speaker microprocessor is differently constructed resulting in differing speaker movements despite use of similar signal durations.

Solutions requiring each speaker to receive separate remote control signals are prohibitively time consuming.

Additionally, speaker movement stops as soon as the remote control key is released. When user P holds down a remote control key for a fixed time, differences in the distances moved may result. As a result, when user P wants uniform speaker heights, variations must be minimized by first returning the speakers to initial "home" positions or the like.

OBJECTS AND SUMMARY OF THE INVENTION:

It is an object of the invention to provide a speaker with drive mechanism that overcomes the problems described above.

It is a further object of the invention to provide a memory to store an original position of a speaker with means for updating the position.

It is a further object of the invention to provide a drive mechanism to move a speaker to a memory stored address updated by an updating means.

It is a further object of the invention to provide a drive mechanism to move a speaker to a memory stored relative new position updated by an updating means.

It is a further object of the invention to provide a speaker with drive mechanism having a simplified manufacture.

Briefly stated, the present invention provides, a speaker with drive mechanism wherein a plurality of the speakers can be moved simultaneously without variations in positioning. The speaker with drive mechanism includes a memory, storing an address, and indicating the current position of the speaker. When a remote control signals indicating a speaker moving instruction is received, the received remote control signals are characterized and the address stored in the memory is updated. The result is a speaker moved to an updated position. Remote control signals indicating a new speaker moving instruction may also be stored and update an address in the memory.

According to an embodiment of the invention, there is provided a speaker with drive mechanism comprising: a speaker support movably supporting the speaker, a memory for storing an original position of the speaker, means for receiving a signal indicating a speaker moving instruction, a driving mechanism for moving the speaker to a new position, and the new position being related to the original position by a characteristic of the signal.

According to another embodiment of the invention there is provided a signal indicating a speaker moving instruction comprising: a characteristic, and the signal characteristic including a number of pulses received by the means for receiving.

According to another embodiment of the invention there is provided an original position comprising: an absolute address relative to a home position.

According to another embodiment of the invention, there is provided a speaker with drive mechanism comprising: a speaker support movably supporting the speaker, a means for detecting an original position of the speaker relative to the speaker support, a means for storing the original position, a means for receiving a signal commanding speaker movement, the signal having a characteristic; a drive mechanism for moving the speaker to a new position relative to the original position; and the new position being related to the original position by the stored characteristic.

According to another embodiment of the invention, there is provided a speaker with drive mechanism further comprising: a remote control, the remote control including a means for producing a signal, the signal including at least a characteristic, the signal also including a command to store an original position.

According to another embodiment of the invention, there is provided a speaker with drive mechanism further comprising: a remote control, the remote control including a means for producing a signal, the signal including at least a characteristic, the signal also including a command to replace the original position with a new position, and the characteristic is a number of pulses According to an embodiment of the invention, there is provided a speaker system comprising: at least first and second speakers, a first speaker driver for driving said first speaker, a second speaker driver for driving said second speaker, a control, a first control means for independently driving the first and second speakers to independent first and second positions, and a second control means for conjointly driving at least first and second speakers relative to the first and second positions, whereby at least first and second speakers are moved together to positions which are relatively identical to their relative positions before operation of the second control means.

The above, and other objects, features and advantages of the present invention will become apparent from the following description read in conjunction with the accompanying drawings, in which like reference numerals designate the same elements.

DETAILED DESCRIPTION OF THE INVENTION

Figure 1:
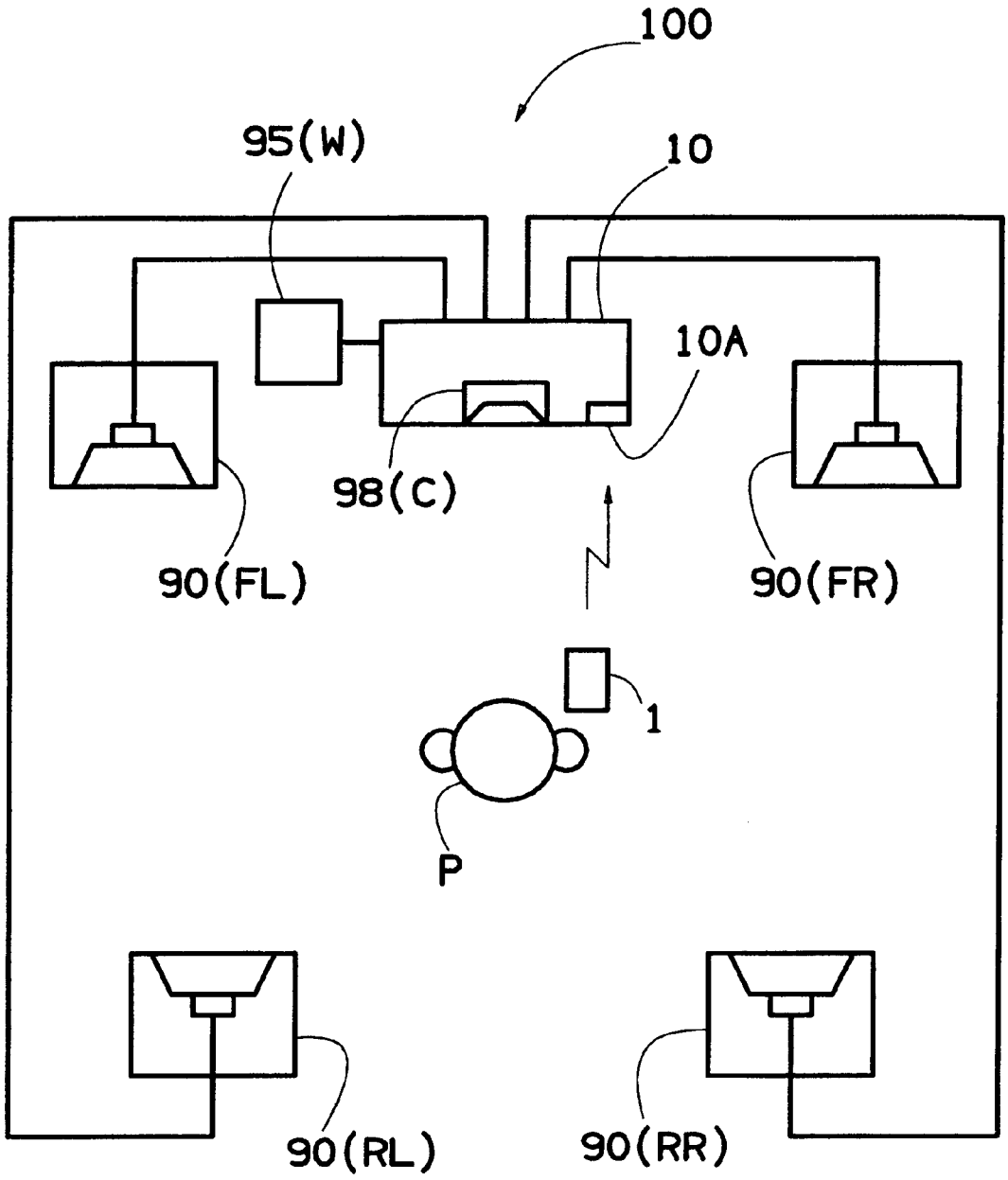
FIG. 1 is a schematic drawing of the arrangement of speakers in a surround sound system.
Figure 2:
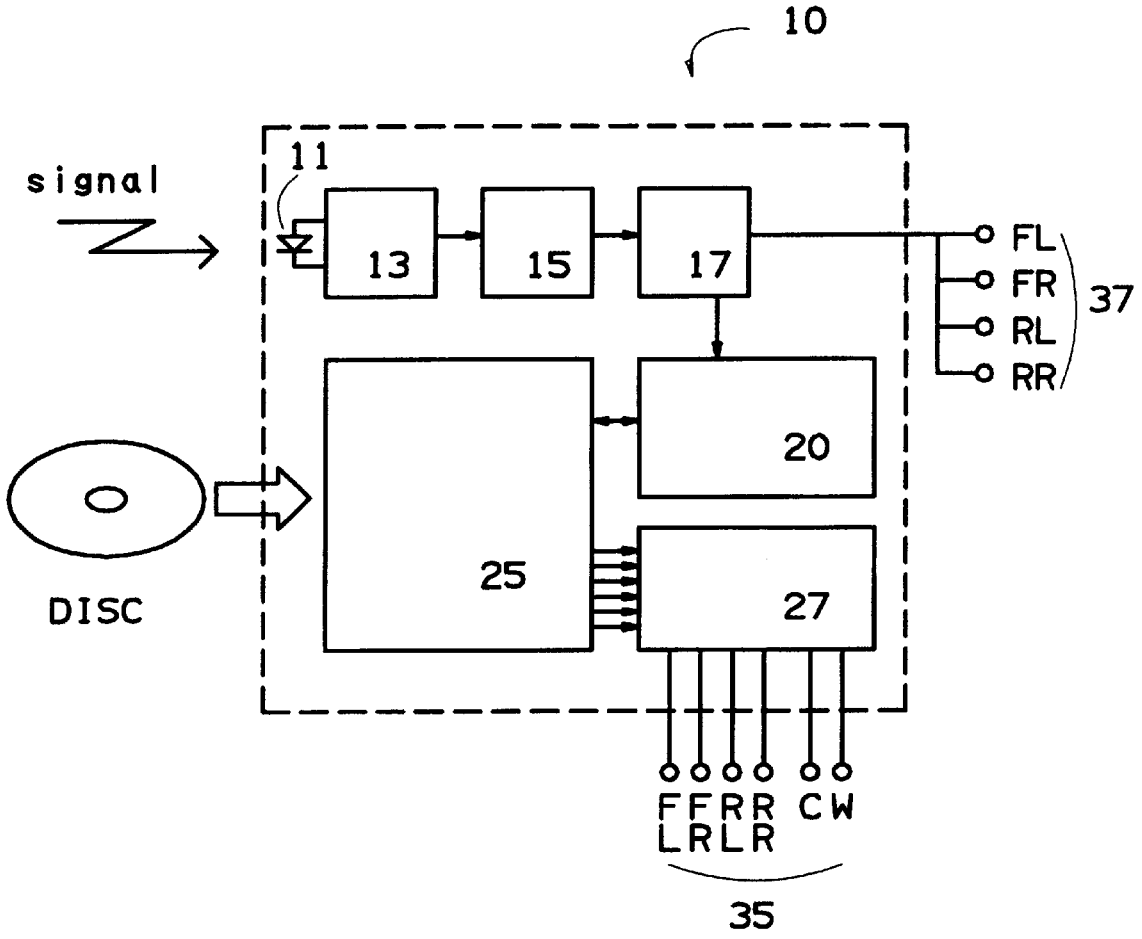
FIG. 2 is a block diagram, showing a disk playback device.

Referring to FIGS. 1 and 2, a surround sound system, shown generally at 1100, includes a disk playback device 10, four speakers with drive mechanisms 90, a center speaker 98, and a woofer speaker 95. Speakers with drive mechanisms 90 are positioned at FL (front left), FR (front right), RL (rear left), and RR (rear right). Speakers with drive mechanisms 90 and disk playback device 10 are connected by multiple audio cords 35 and control cords 37. A receiver 10A employs a light sensitive diode 11 to receive control signals from a remote control 1.

Light-sensitive diode 11 converts infrared remote control signals generated by remote control 1 into electrical signals. The electrical signals are amplified by an amplifier circuit 13, detected by a detector circuit 15, and sent to a waveform shaping circuit 17. Waveform shaping circuit 17 sends a pulse signal, obtained by shaping the received signal, to a system controller 20. The signal is then sent to microprocessors 60 (FIG. 5) in the speakers via control cords 37.

System controller 20 decodes the received pulse signal and controls a disk playback mechanism 25 based upon resulting instruction codes. Based upon system controller 20 operations, disk playback mechanism 25 spins a disk mounted on a turntable. An optical pickup optically reads a plurality of channels of information recorded on the disk. Audio signals are generated by disk playback mechanism 25 from the plurality of channels. The audio signals are then amplified by an amplifier circuit 27 and sent to respective speakers with drive mechanisms 90 connected via audio cords 35.

Figure 3:
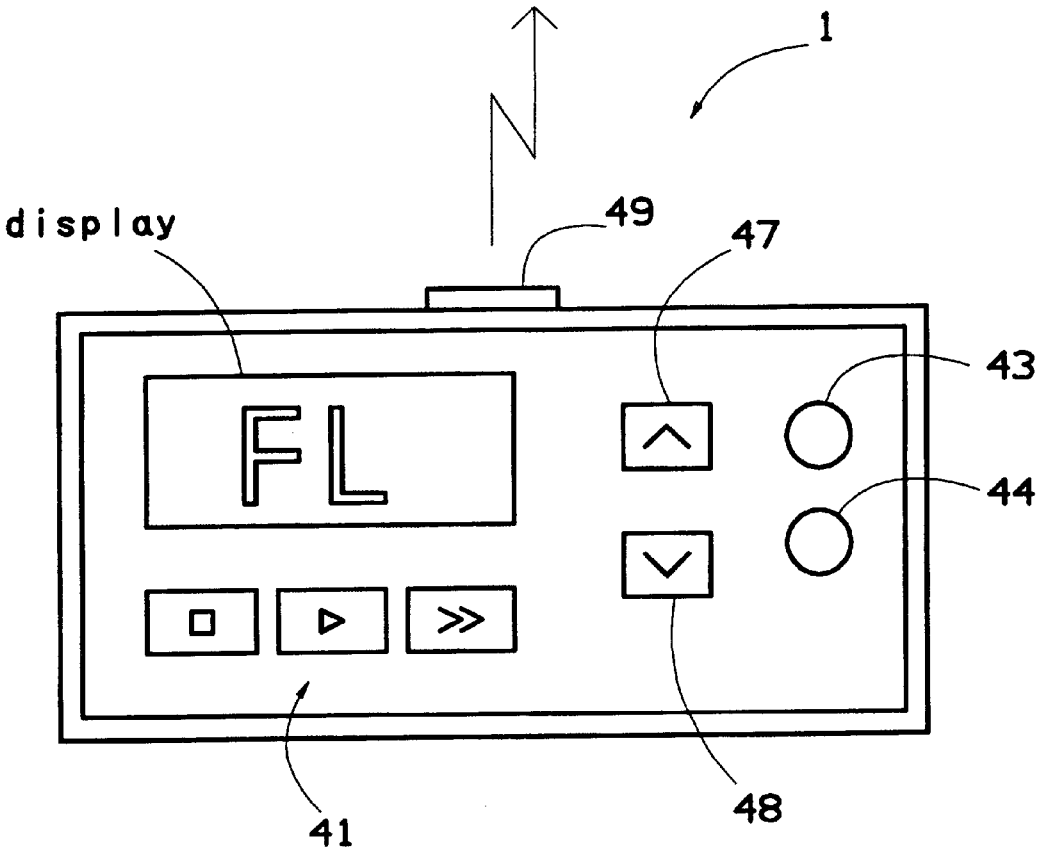
FIG. 3 is a schematic drawing, showing keys on a remote control.
Figure 5:
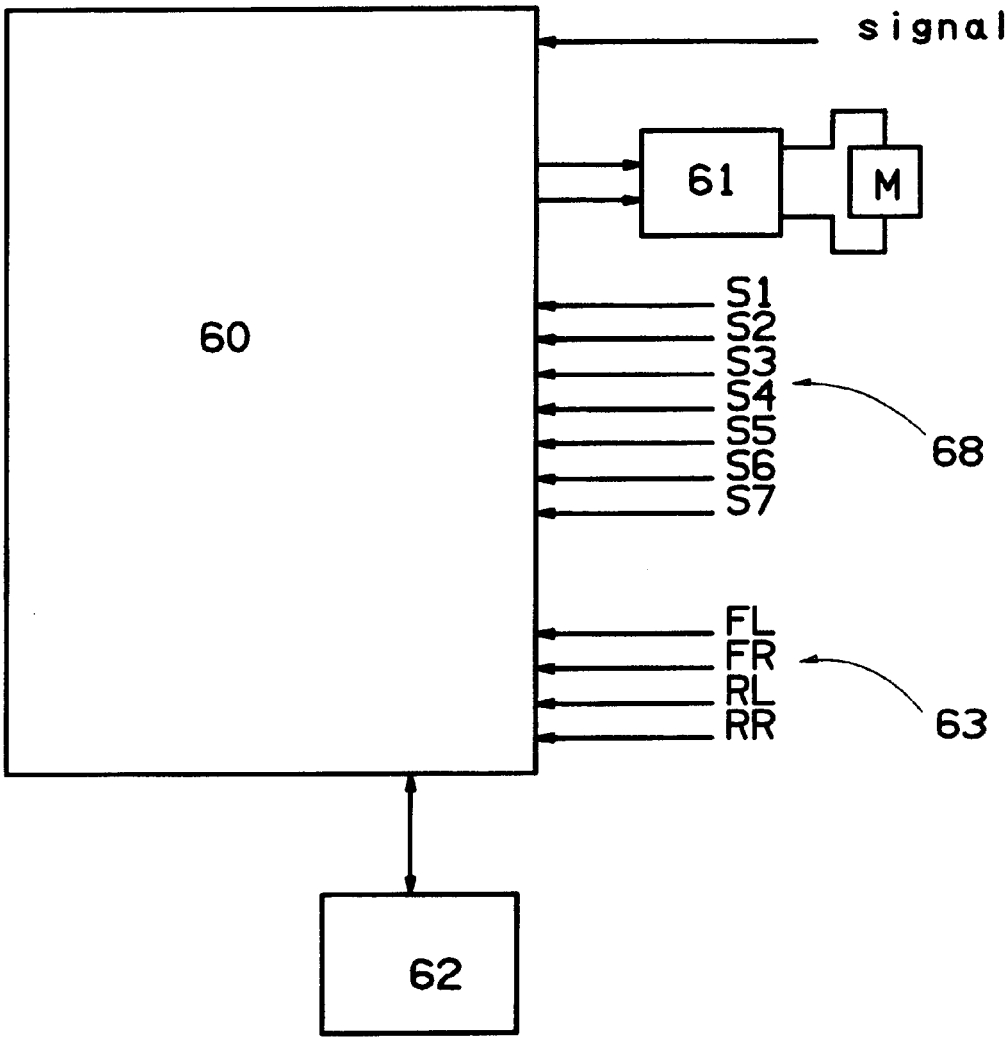
FIG. 5 is a block diagram, showing a microprocessor installed in a speaker with drive mechanism.

Referring to FIGS. 2, 3 and 5, a remote control 1, contains a key group 41 consisting of control keys which control transmission of operating instructions to a disk mounted in disk playback mechanism 25. A mode key 43 is a speaker moving mode selector key. Each time mode key 43 is pressed, one of seven moving modes, described below, is selected. The currently selected setting is shown on a display. Modes include:

1) "ALL" (move all speakers together),
2) "F" (move only the speakers FL, FR),
3) "R" (move only the speakers RL, RR),
4) "FL" (move only the speaker FL),
5) "FR" (move only the speaker FR),
6) "RL" (move only the speaker RL), and
7) "RR" (move only the speaker RR).

A memory key 44 is operated for saving speaker positions. By briefly pressing memory key 44, current positions (addresses) of speakers with drive mechanisms 90 are stored in memory 62. Each speaker with drive mechanism 90 contains a portion of memory 62. By depressing memory key 44, each speaker is moved to the address stored in memory 62.

Both UP Key 47 and DOWN Key 48 are speaker moving keys. Depressing UP key 47 sends a "move up" instruction and depressing DOWN key 48 sends a "move down" instruction based on the speaker moving mode set up using mode key 43. Instructions from the various key operations are encoded and sent from a transmitter 49.

Figure 4:
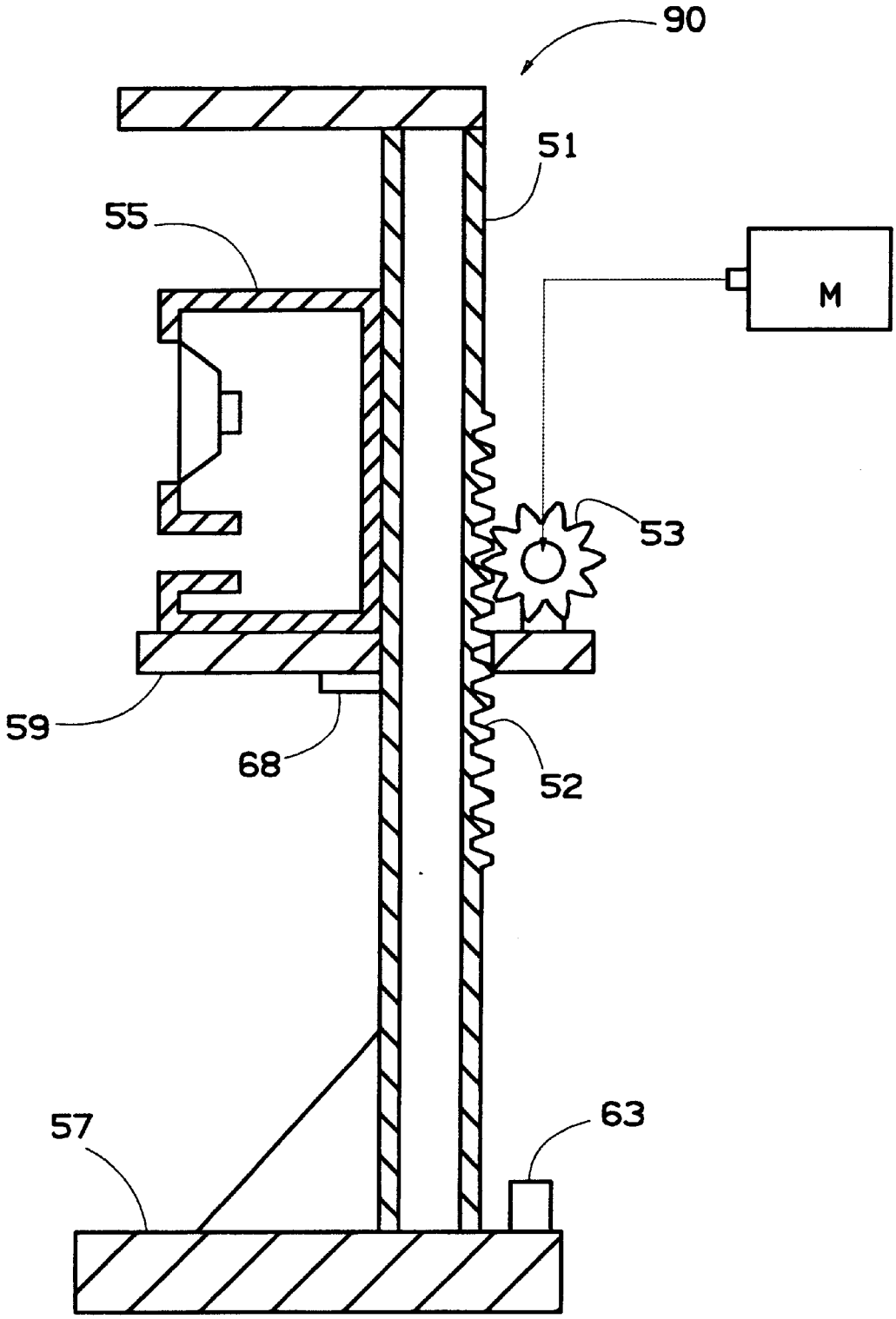
FIG. 4 is a schematic cross-section drawing, showing the structure of a speaker with drive mechanism.

Referring to FIG. 4, a speaker enclosure 55 is attached to a base 59 attached to a drive gear 53 and a motor M. The drive gear 53 projects perpendicularly from a speaker base 57 and meshes with a rack 52 formed on a support shaft 51, allowing vertical motion along support shaft 51.

Figure 6:
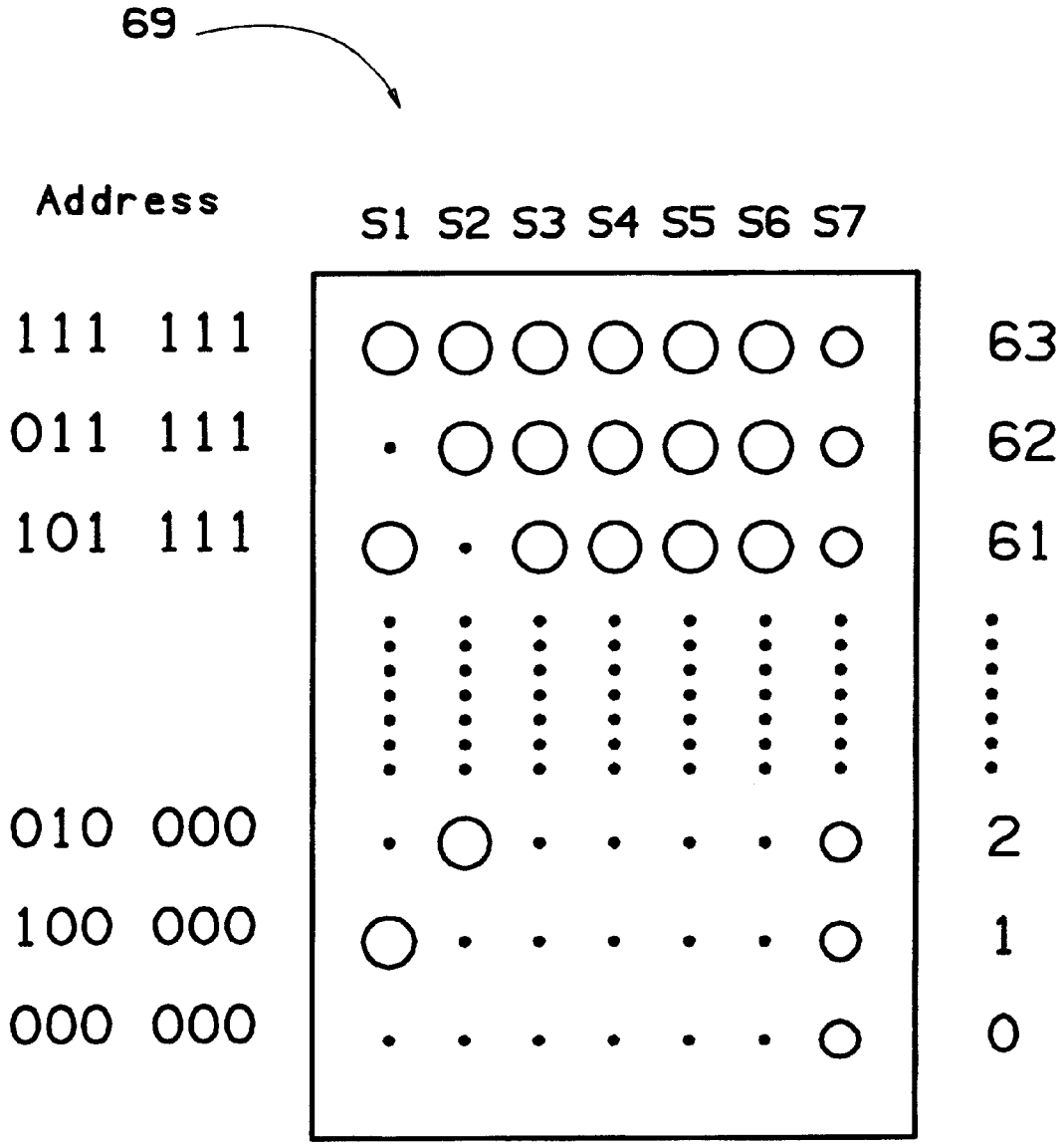
FIG. 6 is a schematic drawing, showing an address map indicating height positions of a speaker with drive mechanism.

Referring to FIGS. 4 and 6, the height of enclosure 55 is determined using a photo-interrupter 68 attached to vertically moving base 59 to detect multiple addressing holes (S1–S6) indicating addresses for positions 0–63 cm formed on an address map 69. Address map 69 also includes multiple corresponding read holes (S7) indicating read positions. For example, "01111" indicates a height of 61 cm from the base position (light shining through represents "1").

Referring to FIG. 5, a selector switch 63 is disposed on the back surface of speakers with drive mechanism 90 to select either FL, FR, RL, or RR. Selector switch 63 may be set freely by the user. The resulting position is referred to as the "selected position" for each individual speakers with drive mechanisms 90.

A Microprocessor 60 includes a ROM storing a control program, a CPU operating according to the control program, and a decoder decoding a remote control signal (pulse signal) received from disk playback device 10. Microprocessor 60 also controls a driver 61 to drive motor M. Additionally, microprocessor 60 receives addresses from photo-interrupter 68 and receives the "selected position" from selection switch 63. The address position (heights 0–63) indicating the current speaker enclosure 55 height is stored in memory 62.

Each speaker with drive mechanism 90 includes separate microprocessors 60, where programs are stored, and separate selector switches 63 adjustable to FL, FR, RL, or RR, thus allowing easy configuration. As a user P arranges each speaker the user P may first place individual speakers with drive mechanisms 90 at test positions and then use the individual selector switches 63 to perfect position settings,.

Figure 7:
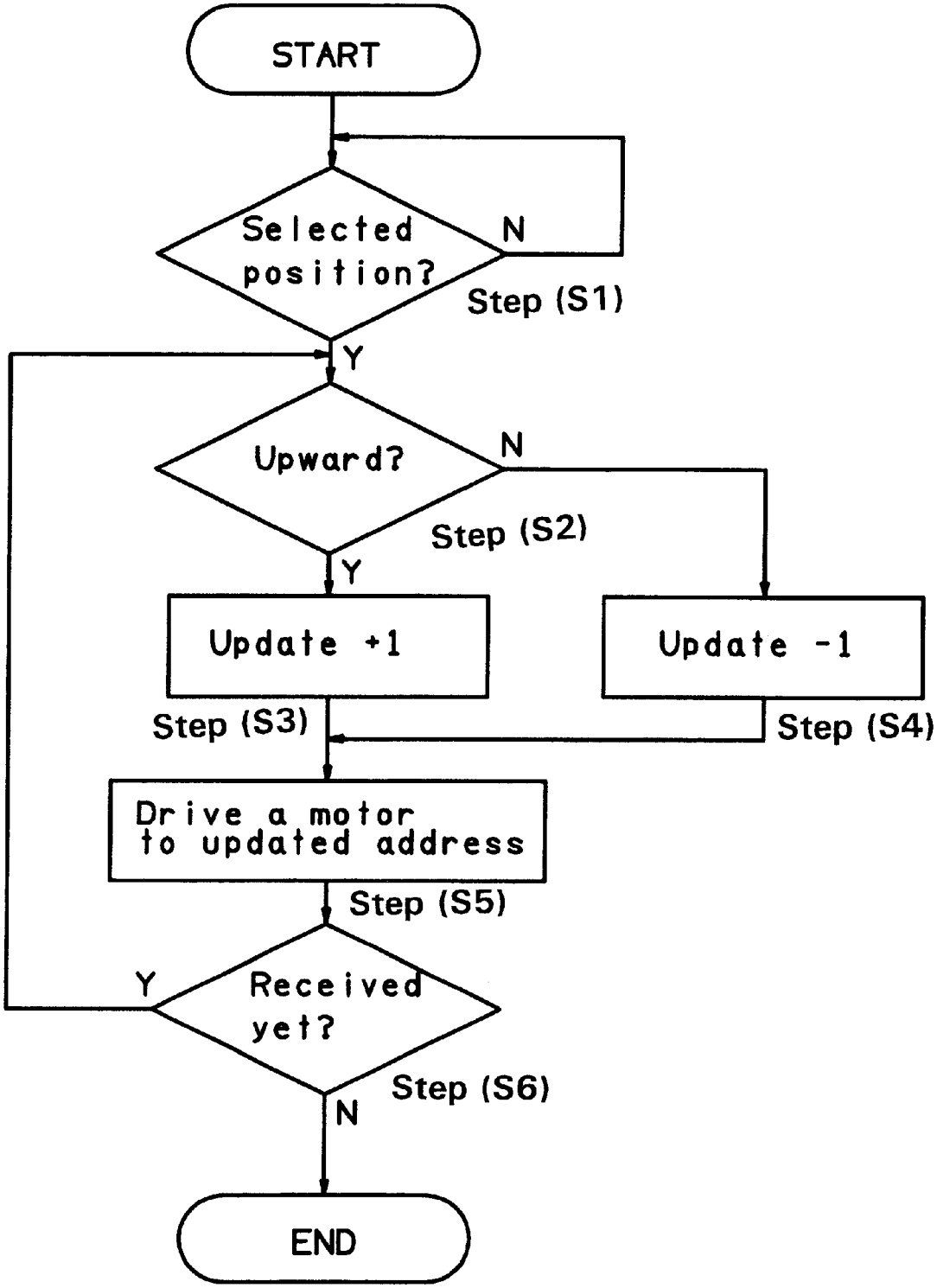
FIG. 7 is a flowchart, showing the operations performed by a microprocessor installed in a speaker with drive mechanism.
Figure 8:
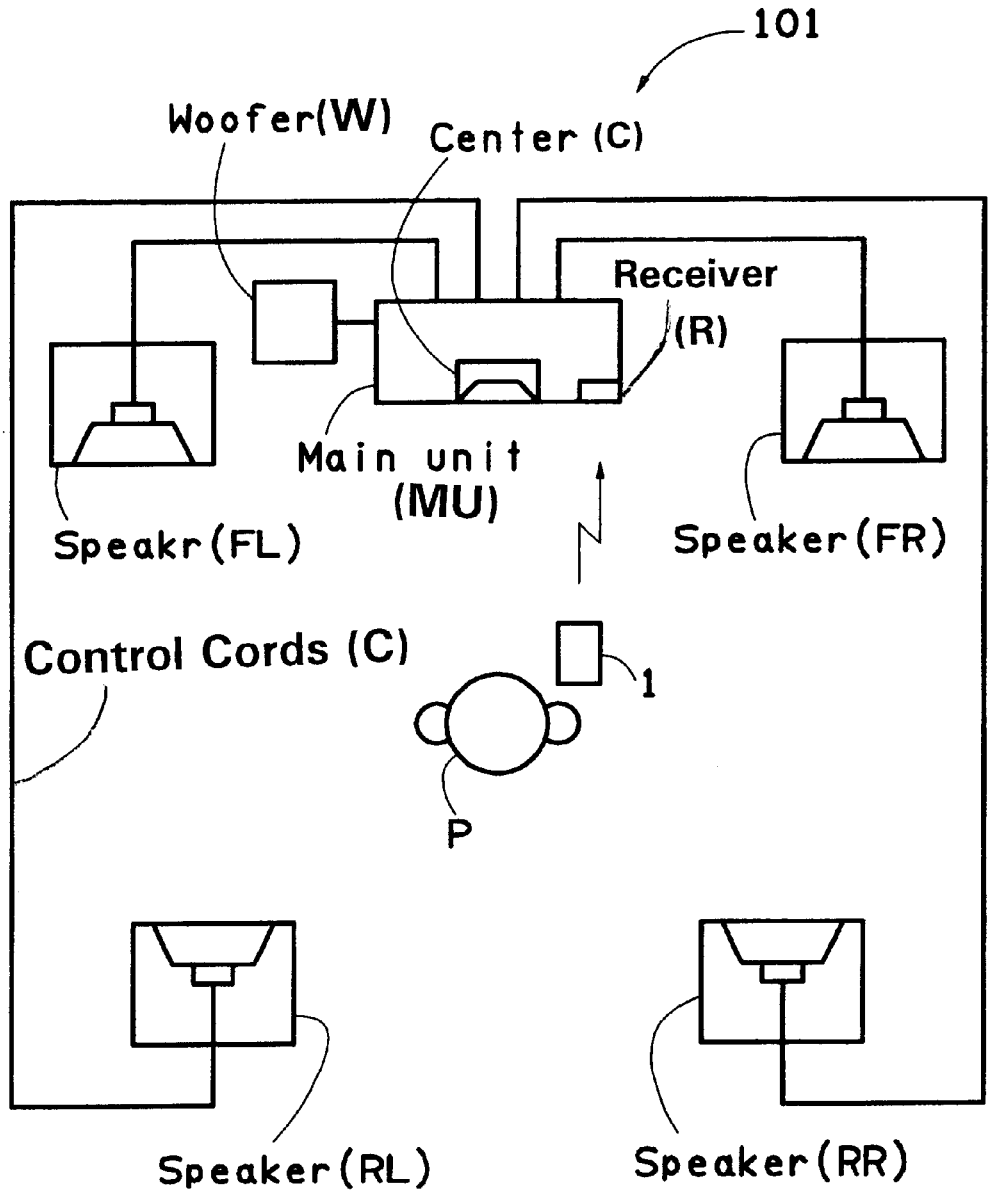
FIG. 8 is a schematic drawing, showing a conventional surround sound system.
Figure 9:
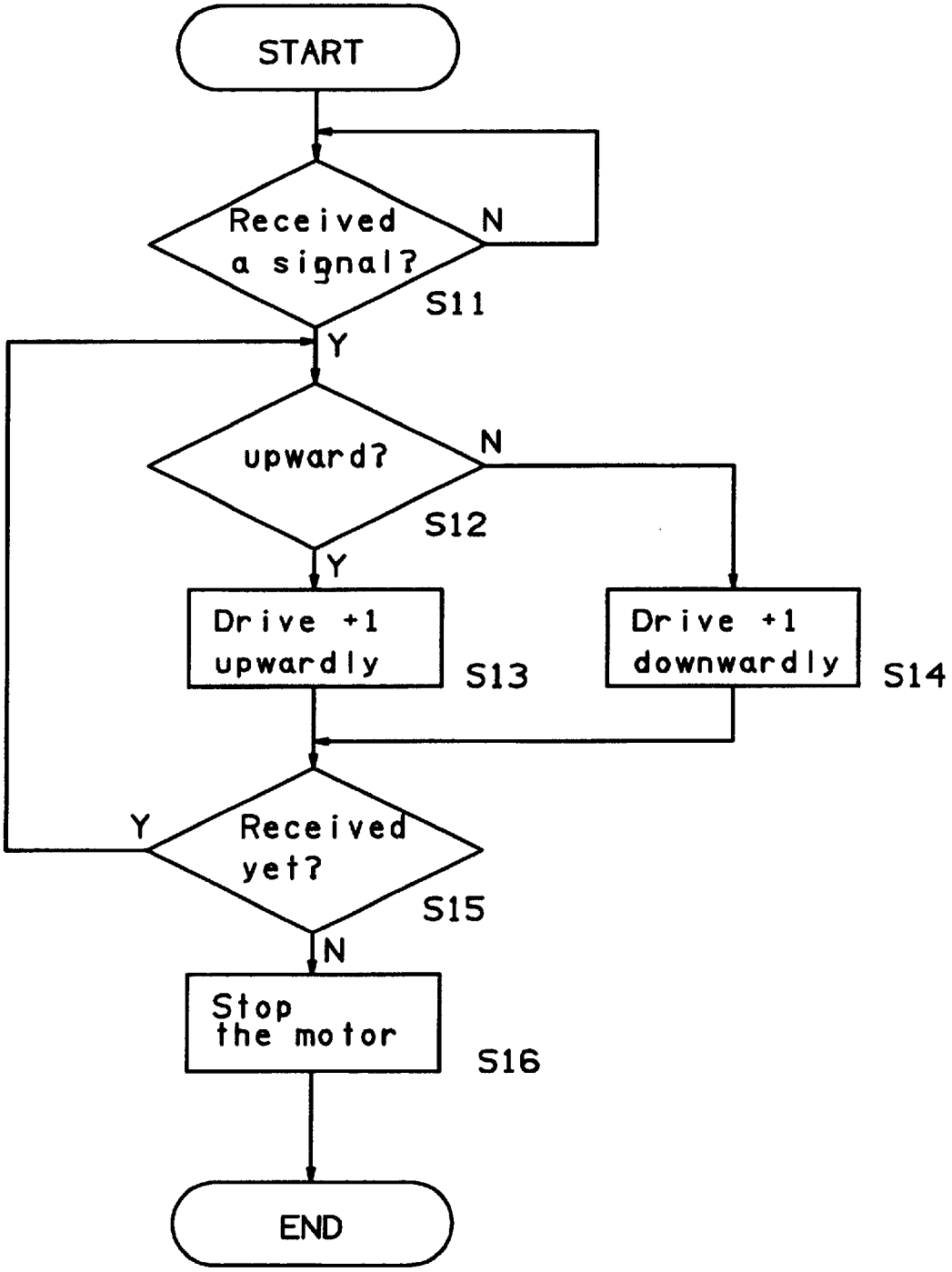
FIG. 9 is a flowchart, showing the operations performed by a microprocessor installed in a conventional speaker with drive mechanism.

Referring to FIG. 7, a flow chart defines description of operations performed by microprocessor 60 installed in a speaker with drive mechanism 90. When a remote control signal indicating speaker movement is received from disk playback device 10, the signal is analyzed to determine if the signal is a moving instruction for a "selected position?" (Step S1) configured by selector switch 63. If the instruction is a moving for "selected position?" (Step S1), operation proceeds to an "upward?" (Step S2). If the instruction is not a moving instruction for "selected position?" (Step S1), the signal analysis is repeated.

At "selected position?" (Step S1), the speaker moving instruction indicates moving speaker enclosure 55 "upward?" (Step S2), then the original address stored in the memory 63 is incremented by +1, "update +1" (Step S3). If the speaker moving instruction indicates moving speaker enclosure 55 downward, then the original address stored in memory 63 is decreased by −1, "update −1" (Step S4). As a result, microprocessor 60 controls driver 61 and energizes motor M, "Drive motor to updated address" (Step S5), to drive speaker enclosure 55 to the original address updated at "update +1" (Step S3) or "update 31 1" (Step S4).

Where receipt of the remote control signal is detected at "received yet?" (Step S6), the operations in Step S2 to Step S5 are repeated. Where receipt of the remote control signal is not detected, the operations performed by microprocessor 60 are ended.

Therefore, where user P actuates a remote control key to move speaker enclosure 55 to a desired point, the transmitted remote control signal is sent to microprocessor 60. Microprocessor 60 updates the address stored in memory 62 based upon the relative information detected from the transmitted remote control 1 signal. Speaker enclosure 55 is then moved to the height indicated by the calculated new address.

As a result, even if microprocessors 60, disposed in speakers with drive mechanisms 90, process a remote control signal at different timings, the ultimate position of speaker enclosures 55, will be the heights indicated by the original address calculated by microprocessor 60. Thus, when a key on remote control 1 is actuated, to move all four speakers together from identical positions, there is no resulting position variation in speaker enclosures 55 at the end of the moving operation.

The position of speaker enclosures 55 is indicated at regular intervals and is stored as an address position. This embodiment uses address map 69 as a position detecting means with heights specified at regular intervals to prevent variation in the heights of the speaker enclosures 55. For example, when position is represented in centimeters and memory key 44 is used to store current speaker enclosure 55 positions, e.g., speaker FL=25 cm, FR=25 cm, RL=55 cm, and RR=60 cm, if speaker enclosures 55 are later at different positions, depressing memory key 44 will move speaker enclosures 55 to the previously stored original address positions.

When using detecting means for speaker positions and signals are sent to move the speaker enclosure 55, the current position in memory is updated based on the received signal, and the speaker is moved based on the information in memory. Thus, speaker enclosure 55 is moved accurately according to the received signal. The signal characteristic may be a pulse signal particularly useful in conducting a speaker moving instruction.

Another embodiment of the invention uses relative addressing. When relative addressing is used, memory 62 is updated from remote control 1 signals received by microprocessor 60, and speaker enclosure 55 is moved to a new relative position. When microprocessor 60 receives a remote control signal to move speaker enclosure 55 the value of received pulse signals is stored in memory 62. Speaker enclosure 55 is then moved, according to the instruction count value, relative to the present position. Thus, speaker enclosure 55 is moved accurately according to a received pulse signal. The embodiment uses address map 69 as a position detecting means, with heights specified at regular steps, and prevents variations in the heights of the speaker enclosures 55. The embodiment is suited for moving a plurality of speakers simultaneously.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims. For example, it is possible to provide the advantages of the present invention by counting rotation pulses of the motor M, moving speaker enclosure 55, as addressing means. For a second example, it is possible to provide the advantages of the present invention and determine speaker enclosure 55 position employing a distance-sensing unit placed alternatively on base 57 or speaker base 59 to provide addressing means relative to the respective base 57 or speaker base 59.

What is claimed is:

1. A speaker with drive mechanism comprising:

a speaker support movably supporting a speaker enclosure;

a memory for storing a first position of said speaker enclosure;

means for receiving a signal indicating a speaker moving instruction;

a driving mechanism for moving said speaker enclosure vertically to a second position; and said second position being related to said first position by a characteristic of said signal.

2. Apparatus according to claim 1, wherein said characteristic includes a number of pulses received by said means for receiving.

3. Apparatus according to claim 1, wherein said first position is an absolute address relative to a home position.

4. A speaker with drive mechanism comprising:

a speaker support movably supporting a speaker enclosure;

means for detecting a first position of said speaker enclosure relative to said speaker support;

means for storing said first position;

means for receiving a signal commanding speaker movement;

said signal having a characteristic;

a drive mechanism for moving said speaker enclosure vertically to a second position relative to said first position; and said second position being related to said first position by said stored characteristic.

5. Apparatus according to claim 4, further comprising:

a remote control;

said remote control including means for producing said signal;

said signal including at least said characteristic; and said signal also including a command to store said first position.

6. Apparatus according to claim 5, wherein said command to store includes a means for updating said first position with said second position.

7. Apparatus according to claim 4, wherein said characteristic is a number of pulses.

8. A speaker system comprising:

at least first and second speaker enclosures;

a first speaker driver for driving said first speaker enclosure; vertically a second speaker driver for driving said second speaker enclosure; vertically a first control means for independently driving said first and second speaker enclosures to independent first and second positions; and a control means for conjointly driving said at least first and second speaker enclosures relative to said first and second positions, whereby said at least first and second speaker enclosures are moved together to positions which are relatively identical to their relative positions before operation of said second control means.

9. Apparatus according to claim 8, further comprising:

first storing means for storing said first position;

second storing means for storing said second position; and said first storing means and said second storing means being independent of each other.

* * * * *